US007621420B2

(12) United States Patent
Bandoh et al.

(10) Patent No.: US 7,621,420 B2
(45) Date of Patent: Nov. 24, 2009

(54) CONTAINER WITH AUTO-OPENING LID

(75) Inventors: Takeshi Bandoh, Kagawa (JP); Daisuke Miyake, Kagawa (JP); Masaho Hayashi, Tokyo-to (JP); Norikazu Shinogi, Tokyo-to (JP); Toshihiko Uenishi, Tokyo-to (JP)

(73) Assignees: Uni-Charm Corporation, Ehime (JP); Dai Nippon Printing Co., Ltd., Tokyo-to (JP)

( * ) Notice: Subject to any disclaimer, the term of this patent is extended or adjusted under 35 U.S.C. 154(b) by 590 days.

(21) Appl. No.: 10/542,077

(22) PCT Filed: Jan. 14, 2004

(86) PCT No.: PCT/JP2004/000178

§ 371 (c)(1),
(2), (4) Date: Jul. 13, 2005

(87) PCT Pub. No.: WO2004/063041

PCT Pub. Date: Jul. 29, 2004

(65) Prior Publication Data

US 2006/0096984 A1 May 11, 2006

(30) Foreign Application Priority Data

Jan. 14, 2003 (JP) ..... 2003-006443

(51) Int. Cl.
*B65D 43/26* (2006.01)
*E05C 1/08* (2006.01)

(52) U.S. Cl. ..... 220/326; 220/254.5; 220/263; 220/264; 220/324; 206/494; 292/145; 292/146; 292/DIG. 11; 292/DIG. 37

(58) Field of Classification Search ..... 206/233, 206/459.1, 459.5, 494, 812; 215/201, 230, 215/301, 305; 220/254.3, 254.5–254.7, 256.1, 220/263, 264, 281, 324, 326, 675, 810, 827, 220/829; 292/145, 146, DIG. 11, DIG. 37, 292/DIG. 63
See application file for complete search history.

(56) References Cited

U.S. PATENT DOCUMENTS 3,860,135 A * 1/1975 Yung et al. ..... 215/213

(Continued)

FOREIGN PATENT DOCUMENTS

CN 2145770 11/1993

(Continued)

*Primary Examiner*—Anthony D Stashick
*Assistant Examiner*—Ned A Walker
(74) *Attorney, Agent, or Firm*—Ladas & Parry LLP

(57) ABSTRACT

In a container with a lid including a container main body, an upper lid attached to the container main body so as to open and close a take-out port of the container main body, a plate spring for urging the upper lid in an opening direction, and a push button that can be operated between a close position, at which it is meshed with the upper lid and keeps the upper lid in a closed state against the plate spring, and an open position, at which the push button is released from the upper lid meshed therewith, a locking member is attached to the push button, the locking member being movable between a locking position, at which the locking member is meshed with the lid that is in the closed state as well as is abutted against the locking surface of the container main body as to the operating direction of the push button to thereby make it impossible for the push button to be operated to the open position, and a release position, at which the locking member is separated from the upper lid and from the locking surface of the container main body and permits the push button to be operated from the close position to the open position.

6 Claims, 14 Drawing Sheets

U.S. PATENT DOCUMENTS

| | | | | | |
|---|---|---|---|---|---|
| 3,930,388 | A | * | 1/1976 | Barras | 70/159 |
| 4,570,816 | A | * | 2/1986 | Ferris et al. | 220/314 |
| 4,625,885 | A | * | 12/1986 | Nichols | 220/214 |
| 4,630,750 | A | * | 12/1986 | Hughes | 220/324 |
| 4,671,943 | A | * | 6/1987 | Wahlquist | 422/300 |
| 4,917,261 | A | * | 4/1990 | Borst | 220/324 |
| 5,031,784 | A | * | 7/1991 | Wright | 215/216 |
| 5,033,778 | A | * | 7/1991 | Niles et al. | 292/66 |
| 5,074,413 | A | * | 12/1991 | Ikuta et al. | 206/320 |
| 5,123,681 | A | * | 6/1992 | Kos et al. | 292/87 |
| 5,131,551 | A | * | 7/1992 | Wells | 220/4.23 |
| 5,370,081 | A | | 12/1994 | Gordon | |
| 5,385,259 | A | * | 1/1995 | Bernstein et al. | 220/495.11 |
| 5,423,419 | A | * | 6/1995 | Wentz et al. | 206/6 |
| 5,699,912 | A | * | 12/1997 | Ishikawa et al. | 206/494 |
| 5,706,968 | A | * | 1/1998 | Riley | 220/326 |
| 5,975,298 | A | * | 11/1999 | Sankey et al. | 206/387.13 |
| 6,006,558 | A | * | 12/1999 | Peters | 70/63 |
| 6,065,626 | A | * | 5/2000 | Huang et al. | 220/254.5 |
| 6,206,221 | B1 | * | 3/2001 | Bando et al. | 220/254.5 |
| 6,367,639 | B1 | | 4/2002 | Mar | |
| 6,454,115 | B1 | * | 9/2002 | Allasia | 220/4.23 |
| 6,485,159 | B2 | * | 11/2002 | Pitts | 362/84 |
| 6,604,628 | B1 | * | 8/2003 | Tanaka et al. | 206/209 |
| 6,655,544 | B1 | * | 12/2003 | Tanaka et al. | 220/835 |
| 6,866,442 | B1 | * | 3/2005 | Petersen | 403/326 |
| 6,951,292 | B2 | * | 10/2005 | Bando et al. | 220/254.5 |
| 7,000,792 | B2 | * | 2/2006 | Arai | 215/237 |
| 7,275,658 | B2 | * | 10/2007 | Decker et al. | 221/61 |
| 7,404,495 | B2 | * | 7/2008 | Keung | 215/237 |
| 2001/0028561 | A1 | * | 10/2001 | Pitts | 362/84 |
| 2002/0185404 | A1 | * | 12/2002 | Donegan | 206/531 |

FOREIGN PATENT DOCUMENTS

| | | |
|---|---|---|
| CN | 2339503 | 9/1999 |
| EP | 1 138 608 A1 | 10/2001 |
| EP | 1138608 | 10/2001 |
| JP | 7-17748 | 3/1995 |
| JP | A 9-59725 | 3/1997 |
| JP | 9-323748 | 12/1997 |
| JP | A 2000-25805 | 1/2000 |
| JP | 3070116 | 4/2000 |
| JP | A 2001-146247 | 5/2001 |
| JP | 2001-197929 | 7/2001 |

* cited by examiner

CONTAINER WITH AUTO-OPENING LID

CROSS-REFERENCE TO RELATED APPLICATIONS

The present application is based on, and claims priority from, International Application No. PCT/JP04/00178, filed on Jan. 14, 2004, titled COVERED CONTAINER, which is incorporated herein by reference.

TECHNICAL FIELD

The present invention relates to a container with a lid arranged such that an open/close type lid disposed on the top surface and the like of a container main body is opened by depressing an operation member.

BACKGROUND ART

There is known a push-once-type container with a lid as a container for wet tissues packed in a bag (refer to, for example, Japanese Patent Application Laid-Open (JP-A) No. 9-59725). The container has an operation member, which is attached to a container main body and depressed thereinto, and the lid, which closes a wet tissue take-out port, is restrained at a close position by meshing the operation member with the lid and opened by being released from the operation member meshed therewith. Further, there is known a container with a lid having an operation member molded together with a container main body, in which the container has a locking mechanism assembled therewith that makes it impossible to depress the operation member in order to prevent the lid from being opened by a misoperation (refer to, for example, JP-A 2001-146247). Further, there is known a container with a lid having an operation member molded together with a container main body, in which the operation member is provided with a push member that pushes the lid upward from the lower surface side thereof as the operation member is depressed (refer to, for example, JP-A 2000-25805).

The locking mechanism disclosed in JP-A 2001-146247 is a slider as a locking member that is made as a part other than the operation member to be depressed. The slider is attached to the container main body and engaged with and disengaged from the operation member to thereby selectively lock and unlock the operation member. However, since the slider does not directly act on the lid, there is a possibility that the lid is opened because the lid meshed with the operation member is released therefrom depending on the degree of elastic deformation of the operation member. Further, when the operation member is provided with the container main body as a different part, the operation member and the locking member must be separately assembled to the container main body, which makes it troublesome to assemble the container.

DISCLOSURE OF THE INVENTION

Accordingly, an object of the present invention is to provide a container with a lid which can securely prevent the lid from being opened by a misoperation and in which an operation member and a locking member can be easily attached to a container main body.

A container with a lid of the present invention, which includes a container main body having a take-out port for a content, a lid attached to the container main body so as to open and close the take-out port, a lid urging device interposed between the container main body and the lid for urging the lid in an opening direction, and an operation member attached to the container main body in the state that the operation member can be operated between a close position at which it is meshed with the lid and keeps the lid in a closed state against the lid urging device and an open position at which the operation member is released from the lid meshed therewith, solves the above problems by a locking member attached to the operation member, the locking member being movable between a locking position, at which the locking member is meshed with the lid that is in the closed state as well as is abutted against a locking surface of the container main body as to an operating direction of the operation member to thereby make it impossible for the operation member to be operated from the close position to the open position, and a release position, at which the locking member is separated from the lid that is in the closed state and from the locking surface of the container main body, respectively and permits the operation member to be operated from the close position to the open position.

According to the present invention, moving the locking member to the locking position makes it impossible for the operation member to be operated to the open position, by which the lid can be prevented from being unintentionally opened. Since the locking member is meshed with the lid at the locking position, an effect of preventing the opening of the lid can be enhanced in comparison with the case that the locking member merely restrains the operation member. Since the locking member is attached to the operation member, the operation member can be assembled to the locking member before they are attached to the container main body, by which a trouble can be reduced, when they are attached to the container main body.

In a container with a lid of the present invention, an operation surface, which is exposed to an outside surface side of the container main body, may be formed to the operation member, and the locking member may be disposed so as to be movable between the locking position and the release position on a back surface side of the operation surface. In this case, it is possible to conceal the locking member behind the operation surface so that it is indistinctive. Since the operation surface can be sufficiently exposed to the outside surface side of the container, the operability thereof is not degraded.

The operation member may be disposed so as to move from the close position to the open position by depressing the operation surface, and the locking member may be disposed so as to move between the locking position and the release position in the state that it is supported by the operation member as to the direction in which the operation surface is depressed. In this case, the operation member and the locking member can be displaced (moved) together as to a direction in the operation member is depressed. Accordingly, the operation member can also be depressed to the open position through the locking member.

A guide surface, which is in contact with the locking member, may be formed on the back surface side of the operation member as well as a spring portion, which protrudes from the guide surface and urges the operation member to the close position, is disposed to the back surface side thereof, and the locking member may be supported so as to be slidable between the locking position and the release position while being in contact with the guide surface by being inserted into a groove formed in the spring portion. When a groove portion is formed in a part of the spring portion disposed on the back surface side of the operation member and the locking member is inserted into the groove portion, the locking member is held so as to be slidable along the guide surface on the back surface side with respect to the operation surface.

An extraction prevention device may be disposed to prevent the locking member from being extracted from the groove portion of the operation member. The extraction prevention device can prevent the locking member from being dropped off by a misoperation.

A shaft portion, which is divided by a slit, may be disposed on the back surface side of the operation member, a groove portion, which is engaged with the shaft portion, may be formed to the locking member so as to open in the direction in which the locking member is inserted into the groove portion of the operation member, and a pawl portion as the extraction prevention device, which reduces the width of the groove, may be disposed in the groove. According to this mode, when the locking member is inserted into the groove of the operation member, the shaft portion is elastically deformed in a diameter reducing direction by narrowing the slit of the shaft portion by causing the pawl portion on the locking member side to come into contact with the shaft portion, and after the operation member gets over the pawl portion, the shaft portion can be returned to its original diameter by an elastically restoring force. To extract the locking member from the operation member, the shaft portion must be elastically deformed so that the slit is narrowed, thereby the shaft portion is appropriately prevented from being extracted.

The groove portion of the locking member may be partitioned by the pawl portion to a first holding portion, to which the shaft portion is fitted when the locking member is located at the release position, and a second holding portion to which the shaft portion is fitted when the locking member is located at the locking position. In this case, the locking member can be held at the release position or the locking position with an appropriate force depending on whether the shaft portion is engaged with the first holding portion or with the second holding portion.

A stepped portion may be disposed on the back surface side of the operation member, and a protruding stopper as the extraction prevention device may be disposed on the surface of the locking member confronting the operation member, the stopper may be capable of being engaged with the stepped portion as to the direction in which the locking member is extracted from the groove portion of the operation member as well as extending in a wedge state as to the direction in which the locking member is inserted into the groove portion of the operation member. According to this mode, when the locking member is inserted into the groove portion of the operation member, the groove portion of the operation member is gradually enlarged by the wedge-shaped stopper, thereby the stopper can be passed through the groove portion. Thereafter, when the locking member is moved in a direction in which it is extracted from the operation member, the stopper is engaged with the stepped portion, thereby the extraction of the locking member can be prevented.

A pawl portion as the extraction prevention device may be disposed to the locking member, the pawl portion more protruding laterally with respect to the extracting direction in which the locking member is extracted from the groove portion of the operation member as it more advances in the extracting direction. According to this mode, when the locking member is inserted into the groove portion of the operation member, the lock member passes through the groove portion because the pawl portion is elastically deformed inward. Thereafter, when the locking member is moved in the direction in which it is extracted from the operation member, the locking member cannot pass through the groove portion of the operation member because pawl portion is elastically deformed outward.

A finger-placing portion may be disposed to the locking member, the finger-placing portion being located at the end of the operation member in the extracting direction thereof with respect to the groove portion and protruding from the operation surface of the operation member. When the finger-placing portion is disposed as described above, the locking member can be easily operated from the outside surface side of the container. Further, when the finger-placing portion protrudes beyond the outside surface of the container main body, the locking member can be more easily operated. When the locking member is moved from the locking position to the release position, the locking member is away from the lid, and the finger-placing portion is more largely drawn out from the operation member. Accordingly, the lid can be opened with a small force by reducing the depressing force of the operation member by the action of a lever by depressing the finger-placing portion.

The container main body may be formed in a constricted shape in which the central portion thereof is constricted when it is viewed from the take-out port side, and the operation member may be disposed in the constricted portion. The container main body can be easily grasped by providing it with the constricted shape. Further, when the container is packaged by a shrink film that wraps the container main body around the outside periphery thereof so as to include the constricted portion, the film is risen from the container main body in the constricted portion, thereby the operation member and the locking member disposed inside of the film is away from the film so that the film can be prevented from being damaged by being rubbed. When the locking member is held at the locking position, even if the finger-placing portion of the locking member and the operation member are depressed by the film, there is not a possibility that the operation member is moved to the open position. In particular, when the spring portion is disposed on the back surface side of the operation member, the operation member is prevented from moving to the open position in the packaged state, thereby the spring performance can be prevented from being deteriorated by the setting thereof.

A leg portion, which is a butted against the locking surface of the container main body at the locking position, may be disposed on the back surface side of the locking member. It is made impossible for the operation member to be depressed when the locking member is located at the locking position by causing the leg portion to come into contact with the locking surface.

A locking concave portion may be disposed to the front edge of the lid that confronts the operation member when the lid is in the closed state, and a locking portion may be disposed to the locking member, the locking portion being inserted into the locking concave portion when the lid is closed and the locking member is moved to the locking position and removed from the locking concave portion when the locking member is moved to the release position. When the locking portion is inserted into the locking concave portion of the lid in association with the movement of the locking member to the locking position, the locking member can securely prevent the lid from being opened. Even if the lid and the operation member are elastically deformed, the lid can be kept in a closed state by securing a sufficient amount of insertion.

A push-up member may be disposed to the operation member or the locking member, the push-up member coming into contact with the lid and pushing up the lid in a direction where it is opened when the operation member is operated from the close position to the open position. According to this mode, even if a resistance is increased because the content is caught between the lid and the container main body, the lid can be securely opened by pushing it upward.

A strap attachment portion, to which a strap can be attached, may be disposed to the container main body. The container main body can be kept in a mode in which it is hung on a wall and the like by attaching the strap thereto, in addition to the mode in which the container main body is placed on a horizontal surface.

Any one of the operation member and the locking member may contain a luminous material. When these members contain the luminous material, an operating portion for opening the lid emits light in a dark place, so that a user is allowed to open the lid easily. Further, since the sizes and the volumes of the operation member and the locking member are smaller than those of the container main body, even if the light emitting material is mixed therewith, it is mixed in a small amount, which is advantageous in cost.

In another container with a lid of the present invention including a container main body having a take-out port for a content, a lid attached to the container main body so as to open and close the take-out port, a lid urging device interposed between the container main body and the lid for urging the lid in an opening direction, and an operation member attached to the container main body in the state that the operation member can be operated between a close position at which it is meshed with the lid and keeps the lid in a closed state against the lid urging device and an open position at which the operation member is released from the lid meshed therewith, the container main body may be formed in a shape in which the central portion thereof is constricted when it is viewed from the take-out port side, and the operation member may be disposed in the constricted portion.

Further, in still another container with a lid of the present invention including a container main body having a take-out port for a content, a lid attached to the container main body so as to open and close the take-out port, a lid urging device interposed between the container main body and the lid for urging the lid in an opening direction, and an operation member attached to the container main body in the state that the operation member can be operated between a close position at which it is meshed with the lid and keeps the lid in a closed state against the lid urging device and an open position at which the operation member is released from the lid meshed therewith, the container main body may include a strap attachment portion to which a strap can be attached.

BEST MODE FOR CARRYING OUT THE INVENTION

Figure 1A:
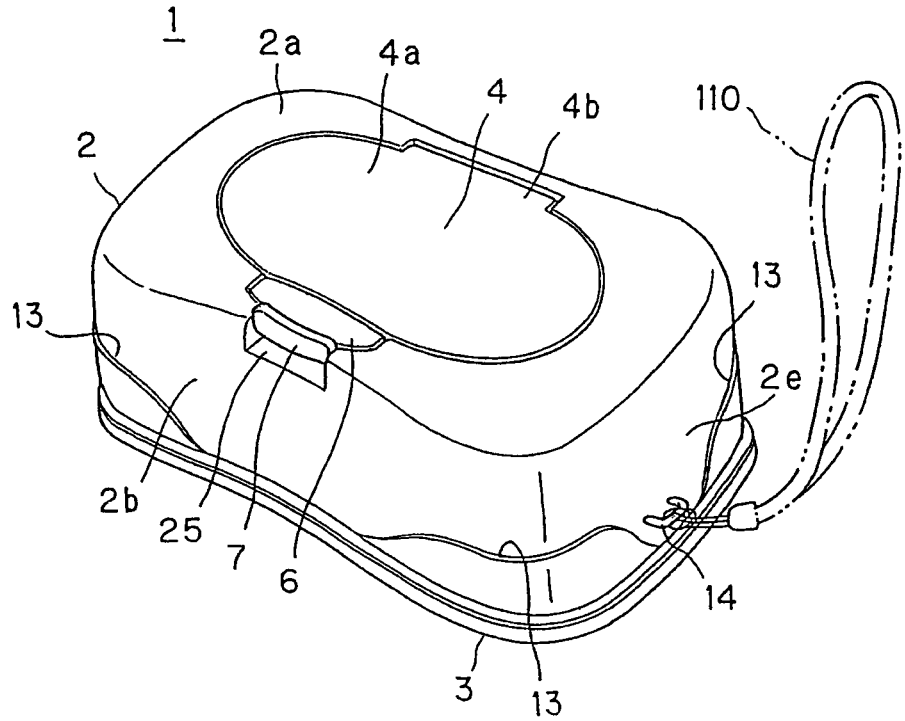
FIG. 1A is a perspective view showing the external appearance of a container according to an embodiment of the present invention in the state that an upper lid is closed.
Figure 1B:
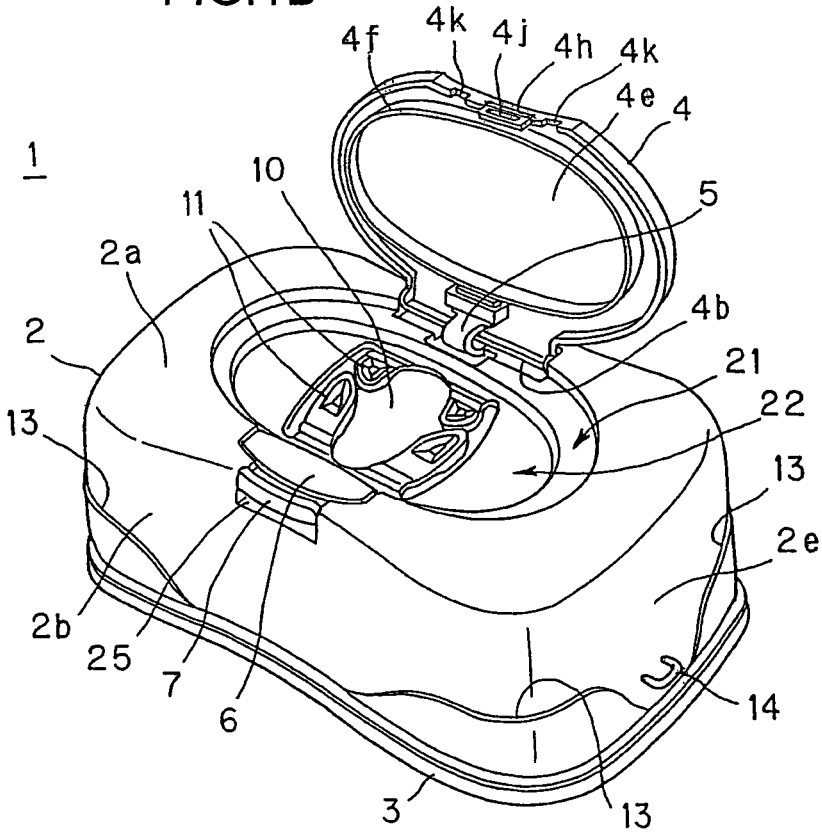
FIG. 1B is a perspective view showing the external appearance of the container according to the embodiment of the present invention in the state that the upper lid is opened.
Figure 2:
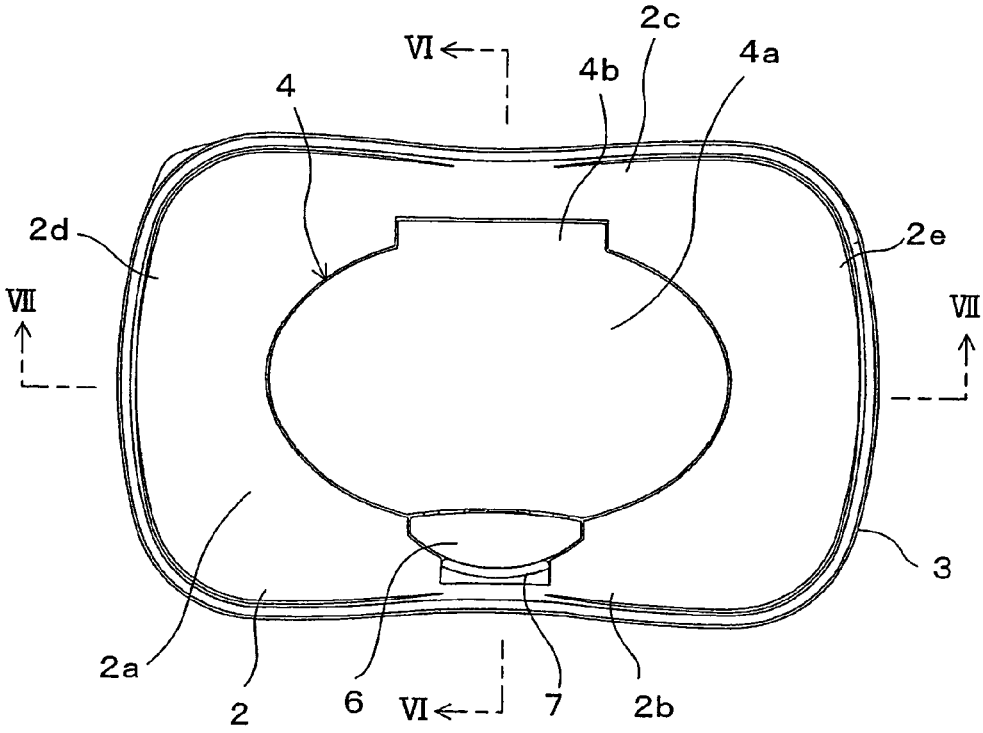
FIG. 2 is a plan view of the container with the lid.
Figure 3:
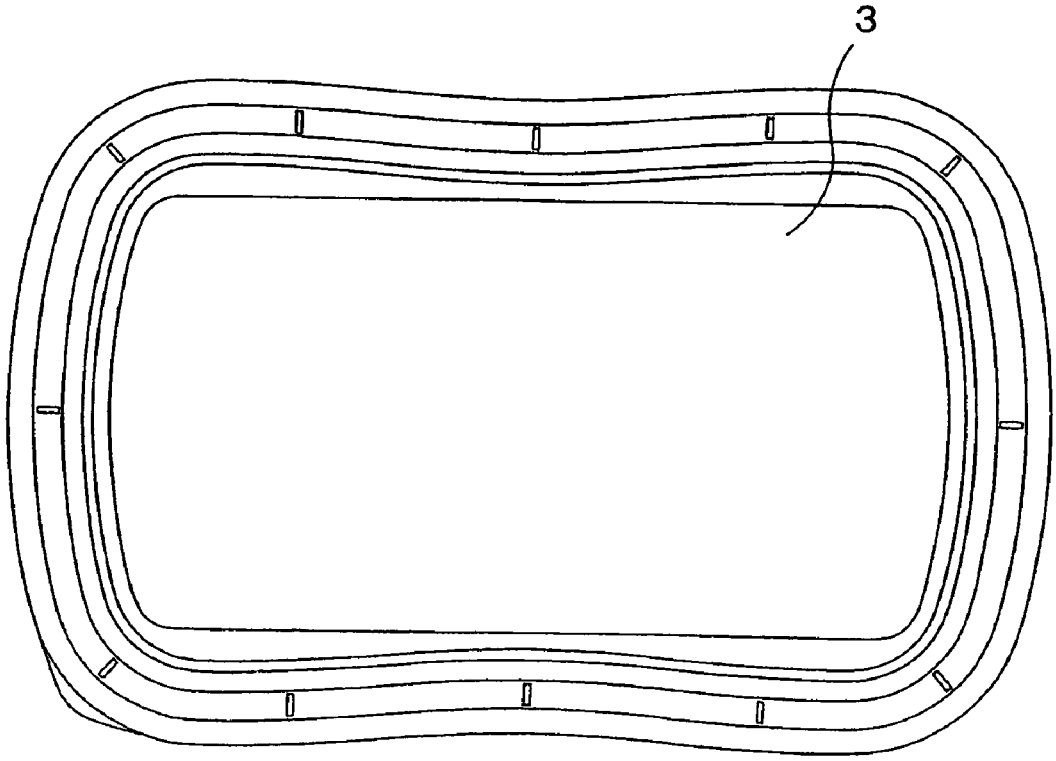
FIG. 3 is a bottom view of the container with the lid.
Figure 4:
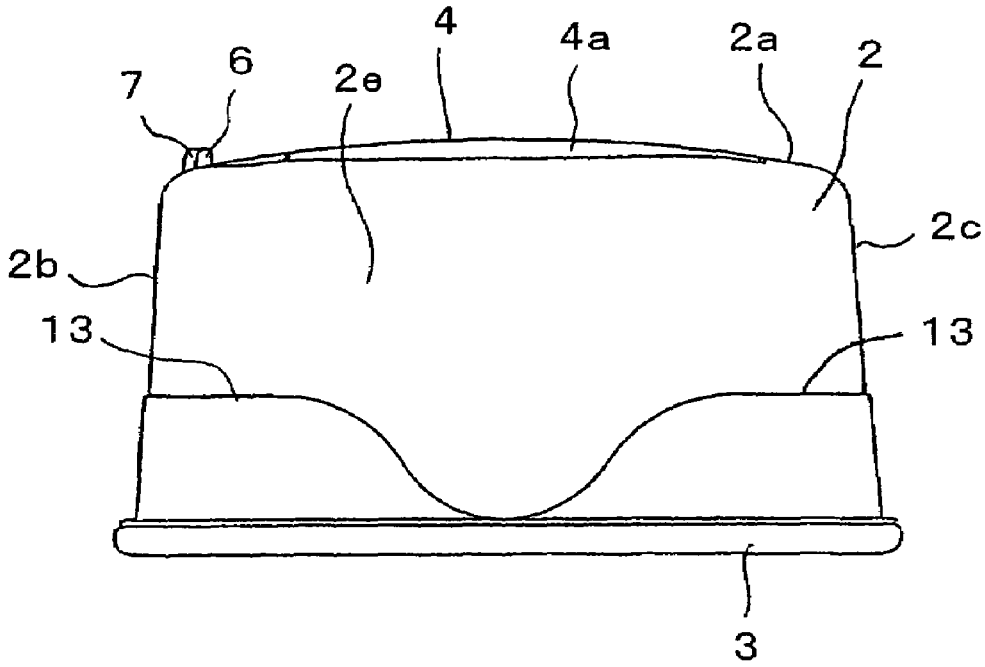
FIG. 4 is a right side view of the container with the lid.
Figure 5:
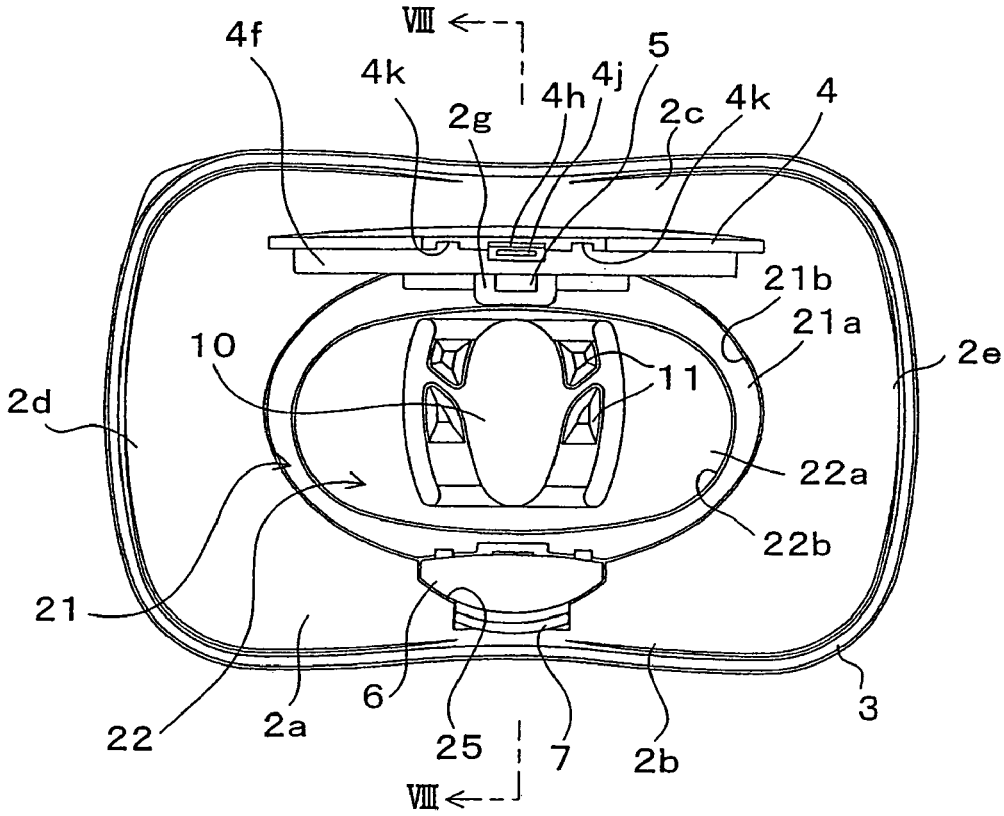
FIG. 5 is a plan view when the upper lid is opened.
Figure 6:
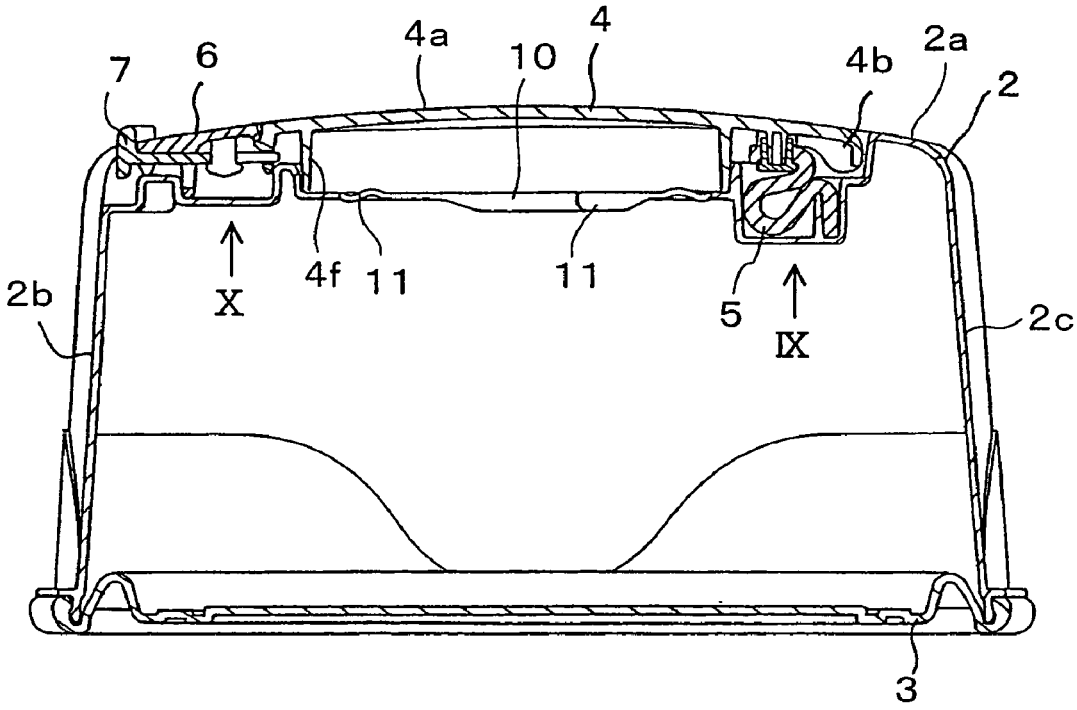
FIG. 6 is a sectional view taken along the line VI-VI of FIG. 2.
Figure 7:
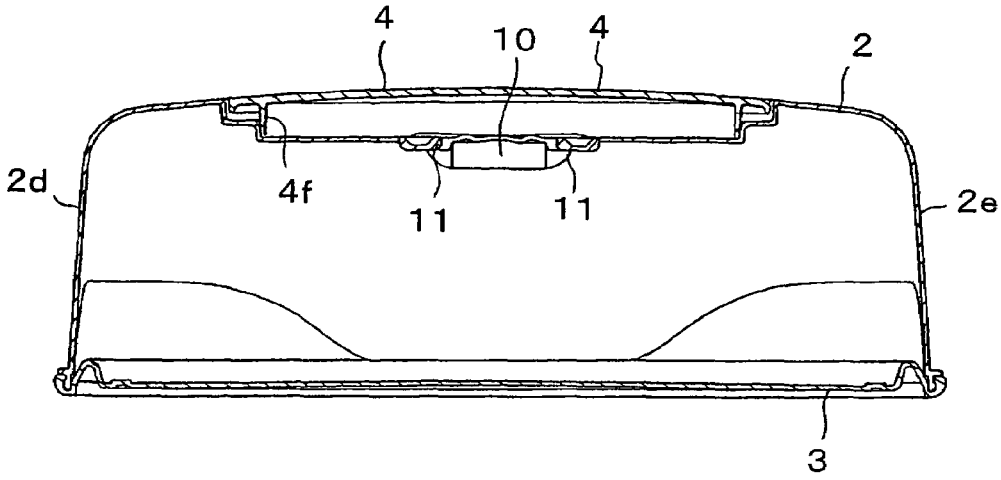
FIG. 7 is a sectional view taken along the line VII-VII of FIG. 2.
Figure 8:
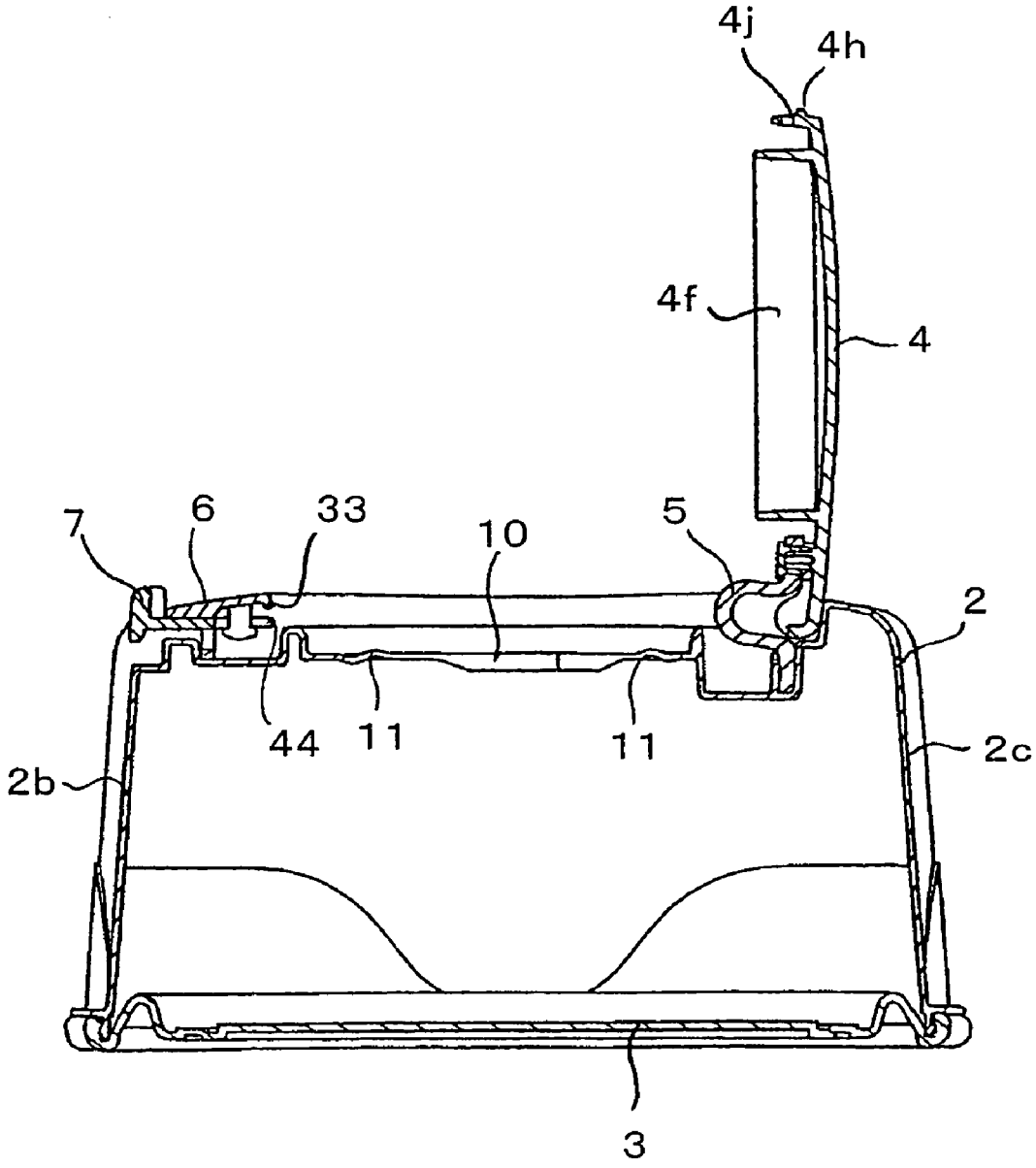
FIG. 8 is a sectional view taken along the line VIII-VIII of FIG. 5.

FIGS. 1A and 1B are perspective views showing the external appearance of a container according to an embodiment of the present invention, wherein FIG. 1A shows the state that an upper lid is closed, and FIG. 1B shows the state that the upper lid is opened, respectively. Further, FIG. 2 is a plan view, FIG. 3 is a bottom view, FIG. 4 is a right side view, FIG. 5 is a plan view when the upper lid is opened, FIG. 6 is a sectional view taken along the line VI-VI of FIG. 2, FIG. 7 is a sectional view taken along the line VII-VII of FIG. 2, and FIG. 8 is a sectional view taken along the line VIII-VIII of FIG. 5.

As shown in these figures, a container with a lid 1 includes a container main body 2, a bottom lid 3 for closing the opening of the container main body 2 on the bottom surface side thereof, an upper lid 4 disposed on the top surface 2*a* side (upper surface side in FIGS. 1A and 1B) of the container main body 2, a push button 6 as an operation member that is operated to open the upper lid 4, and a lock 7 as a locking member for restraining the push button 6. The container main body 2, the bottom lid 3, the upper lid 4, the push button 6, and the lock 7 are resin-molded products. When the bottom lid 3 is taken out from the container main body 2, the bottom surface of the container main body 2 is substantially entirely opened, and a package of wet tissues can be loaded to the inside of the container main body 2 from the opening.

Figure 17:
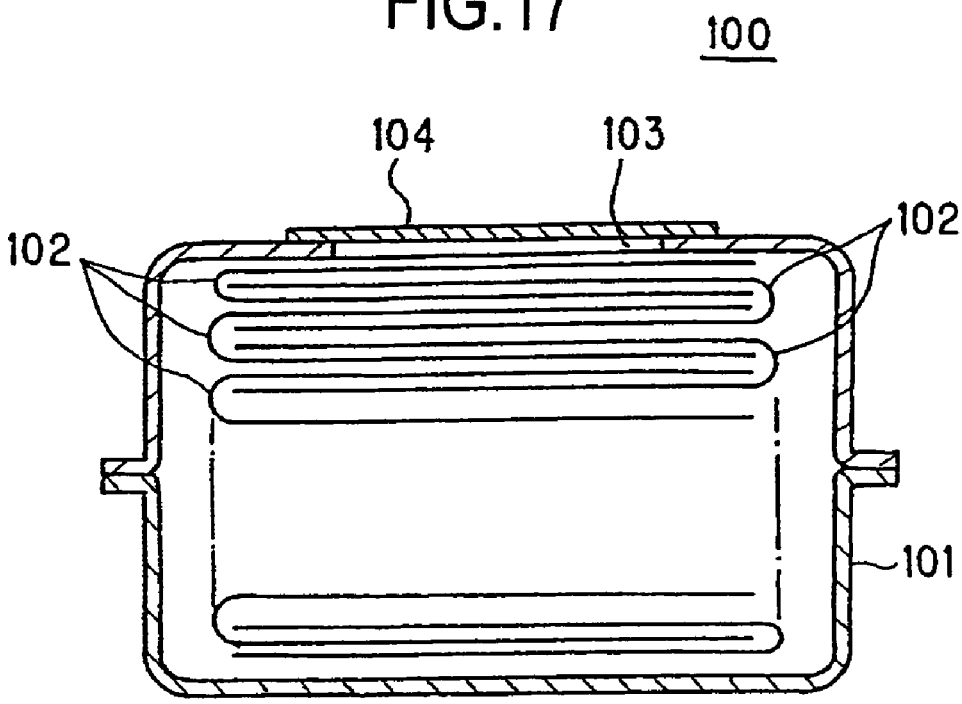
FIG. 17 is a sectional view of a package of wet tissues accommodated in the container with the lid.

The package will be explained here. As shown in FIG. 17, the package 100 is arranged such that a multiplicity of wet tissues 102, . . . , 102 as a content are folded and accommodated in a bag 101 having a seal property so that each predetermined number (for example, each one) of the wet tissues 102 can be successively taken out from an opening 103. The opening 103 is closed by a seal 104 which is exfoliated when the package 100 is used (that is, it is accommodated in the container 1).

As apparent from FIG. 1B, a take-out port 10 is formed on the upper portion of the container main body 2. Each predetermined number of the wet tissues 102, which are accommodated in the package 100 in the container 1, can be drawn out from the take-out port 10. As known well, the take-out port 10 is provided with flaps 11 that hold the end of a next wet tissue 102 to be pulled up when wet tissues 102 are taken out. The shape of the flaps 11 is not limited to the illustrated one and may be variously modified. When the opening 103 of the package 100 is provided with the same function as that of the flaps 11, the flaps 11 may be omitted.

Next, the characteristics of the external appearance of the container 1 will be explained. As apparent from FIGS. 2 and 3, the container main body 2 is formed in such a shape that it is more constricted at the centers thereof than both the ends thereof in a right to left direction when it is viewed in an up and down direction, and the bottom lid 3 is also formed in a shape that is constricted at the centers thereof following the container main body 2. The push button 6 is disposed at a constricted portion. Provision of the constricted shape with the container 1 is advantageous in that the container 1 can be easily gripped at the central portion thereof. Stack lines 13 are formed around the outside periphery of the container main body 2. The stack lines 13 are formed by protruding the lower portions of the side surfaces 2*b* to 2*e* of the container main body 2 externally by a predetermined amount. When a plurality of container main bodies 2 are stacked vertically, the stack lines 13 are engaged with the lower end of a container main body 2 located on an upper side and cause an appropriate gap between container main bodies 2.

As apparent from FIGS. 1A and 1B, a ring portion 14 as a strap attachment portion is disposed on the right side surface 2*d* of the container main body 2. A strap 110 can be knotted to the ring portion 14. The container 1 can be hung down from a hook or the like through the strap 110 attached to the ring portion 14. When, for example, the wet tissues 102 are used to an infant, the container 1 can be kept by being hung down from a baby crib. Note that the ring portion 14 is not shown in FIG. 2 and the figures subsequent to FIG. 2. The position where the ring portion 14 is disposed is not limited to the position shown in FIGS. 1A and 1B, and it may be disposed at any appropriate position.

Next, the arrangements of the portions relating to the upper lid 4 and to the opening and closing thereof will be explained. The upper lid 4 is disposed so as to open and close the take-out port 10 by turnably engaging turning shafts 4*c* (refer to FIG. 9) disposed at both the ends of the rear end 4*b* thereof with the container main body 2. The upper surface 4*a* of the upper lid 4 is swelled out so that the top surface 2*a* of the container main body 2 and the upper surface 4*a* of the upper lid 4 draw a continuing curve together when the upper lid 4 is closed (refer to FIG. 4). As shown in FIGS. 1B, 6 and 8, a plate spring 5 as a lid urging device is interposed between the container main body 2 and the upper lid 4 to urge the upper lid 4 in an opening direction. The plate spring 5 is preferably composed of an elastic member of natural rubber, synthetic rubber, and the like. However, the container of the present invention is not limited to the one in which the plate spring 5 is composed of the above material. For example, the plate spring 5 may be formed using spring steel and the like in place of the rubber material. The lid urging device is not limited to a device formed in a plate-shaped.

Figure 9:
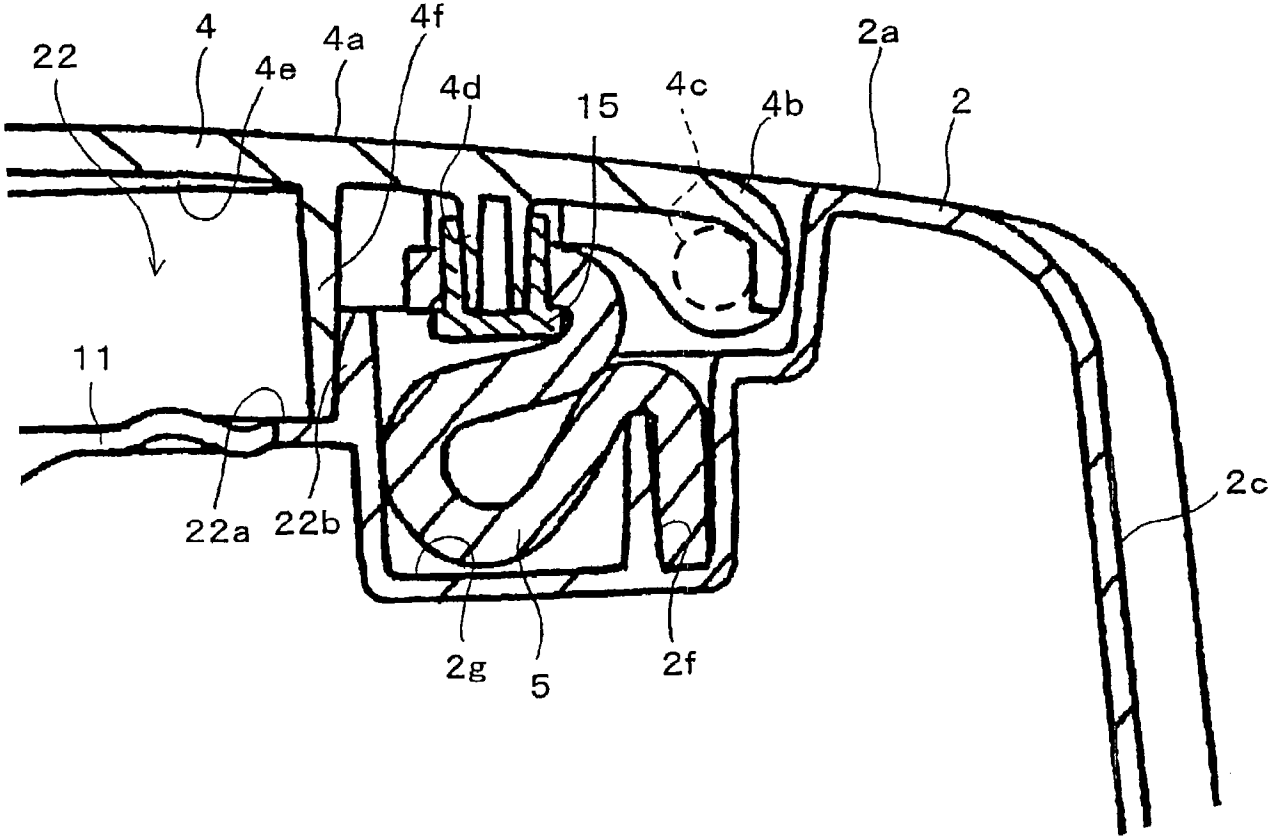
FIG. 9 is an enlarged view of a IX portion of FIG. 6.

As shown in FIG. 9 in detail, an end of the plate spring 5 is fixed to a plate spring mounting hole 2*f* of the container main body 2, and the other end thereof is attached to a spring attachment shaft 4*d* of the upper lid 4 through a cap 15. In the closed state of the upper lid 4, the plate spring 5 is accommodated in a spring accommodation groove 2*g* of a container main body 2 by being bent so as to draw a loop. When the upper lid 4 is opened, the plate spring 5 extends, thereby the upper lid 4 held in an approximately upright state by the elastically restoring force of the plate spring 5 (refer to FIG. 8).

A first concave portion (top surface side concave portion) 21 is formed on the top surface 2*a* of the container main body 2 in conformity with the shape of the outside periphery of the upper lid 4, and a second concave portion 22 is disposed in the first concave portion 21 at a position one step lower than it. The take-out port 10 and the flaps 1 described above are formed on a bottom plate 22*a* of the second concave portion 22. As shown in FIG. 1B, an elliptic- or oval-shaped close rib 4*f* is formed on the back surface 4*e* of the upper lid 4 in correspondence to the second concave portion 22. When the upper lid 4 is closed, the close rib 4*f* enters just inside of the side wall 22*b* of the second concave portion 22, thereby the periphery of the take-out port 10 is surrounded by the close rib 4*f* and the side wall 22*b* doubly. Accordingly, a practically sufficient sealing performance can be secured around the take-out port 10 of the container 1.

As shown in FIGS. 1B and 5, a pawl portion 4*h* is formed to the upper lid 4 at the center of the front end thereof to keep the upper lid 4 in a closed state. Further, a lock hole 4*j* as a locking concave portion is formed just below the pawl portion 4*h* of the upper lid 4. Note that the lock hole 4*j* may be formed as a hole whose one end is closed. Further, cutouts 4*k* are formed on both the sides of the pawl portion 4*h*. The pawl portion 4*h*, the lock hole 4*j* and the cutouts 4*k* are disposed in correspondence to the push button 6 and the lock 7. The push button 6 and the lock 7 will be explained below.

Figure 10:
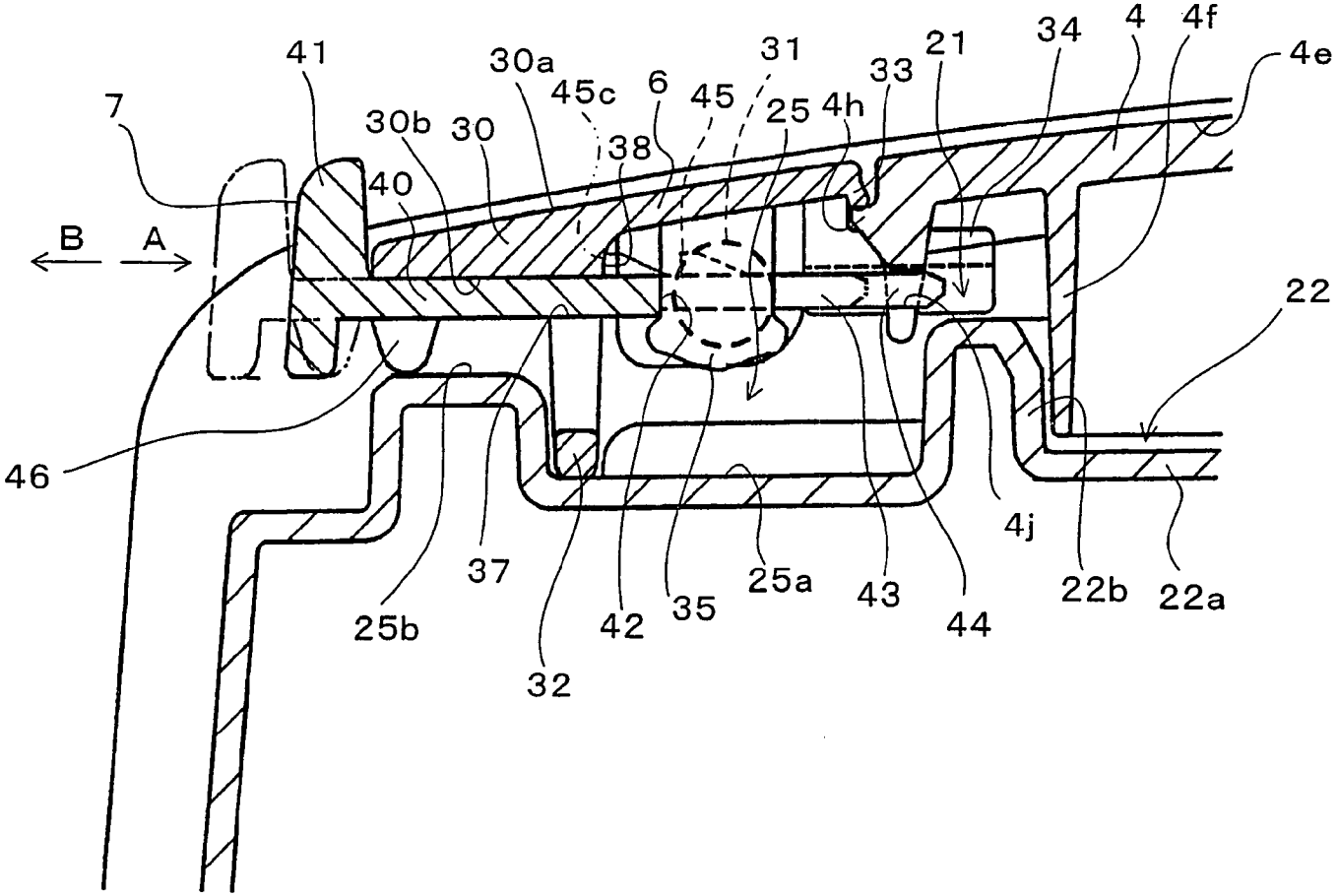
FIG. 10 is an enlarged view of a X portion of FIG. 6.
Figure 11:
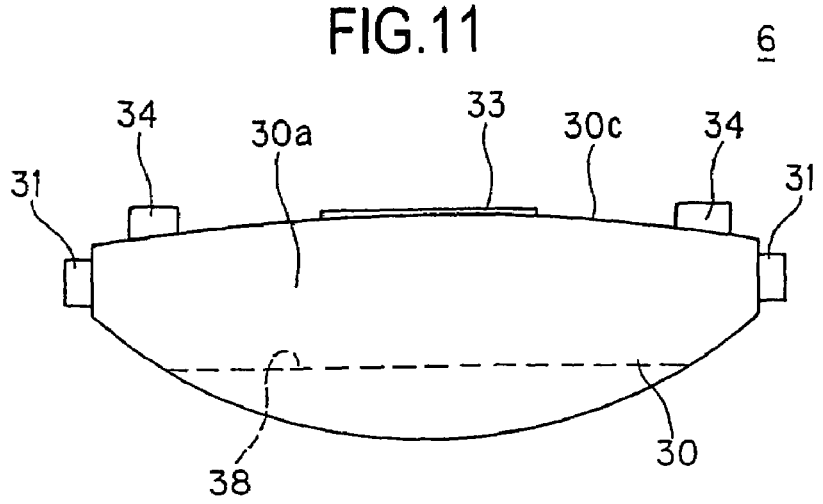
FIG. 11 is a plan view of a push button.
Figure 12:
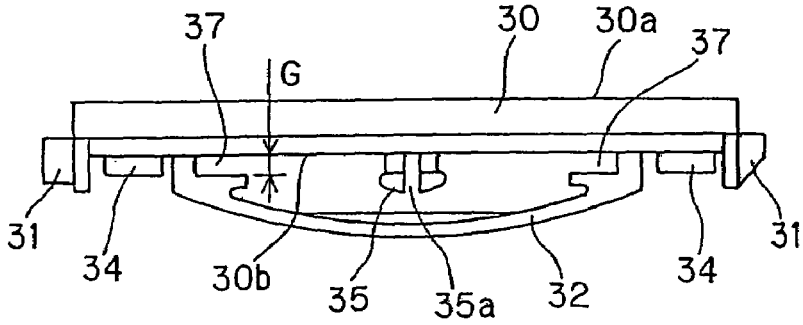
FIG. 12 is a front elevational view of the push button.
Figure 13:
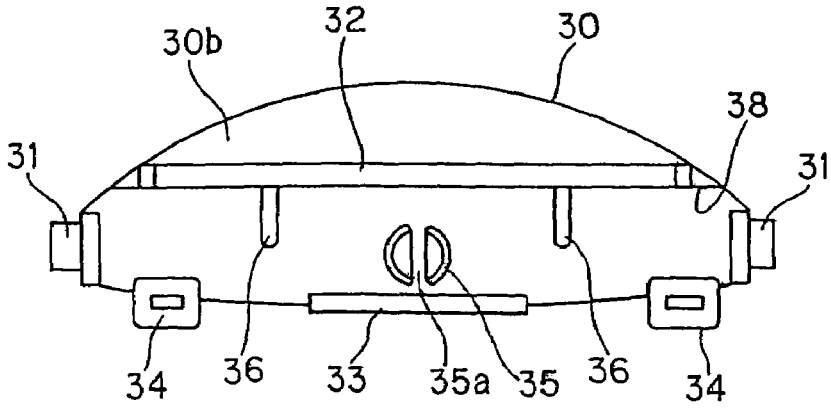
FIG. 13 is a bottom view of the push button.

FIGS. 11 to 13 show the push button 6 in detail, wherein FIG. 11 is a plan view, FIG. 12 is a front elevational view, and FIG. 13 is a bottom view. As shown in these figures, the push button 6 includes a plate-shaped main body 30 having an operation surface 30*a*, support shafts 31 protruding from both the sides of the main body 30, a spring portion 32 protruding from a guide surface 30*b* on the back side of the main body 30 in a bow-shape, a pawl portion 33 disposed to the main body 30 at the center of the rear edge portion 30*c* thereof, push-up portions 34 disposed on both the sides of the pawl portion 33, a shaft portion 35 interposed between the pawl portion 33 and the spring portion 32, and a pair of reinforcing ribs 36 extending from the guide surface 30*b*. A groove portion 37, into which the lock 7 is inserted, is formed to the joint portion (base end portion) of the spring portion 32 where the spring portion 32 is joined to the guide surface 30*b*. Further, the shaft portion 35 is divided into two portions by a slit 35*a* extending in the inserting direction of the lock 7. Further, a stepped portion 38 is formed at an end (end in the direction where the lock 7 is inserted) of the guide surface 30*b* of the main body 30 (refer to FIG. 10).

Figure 14:
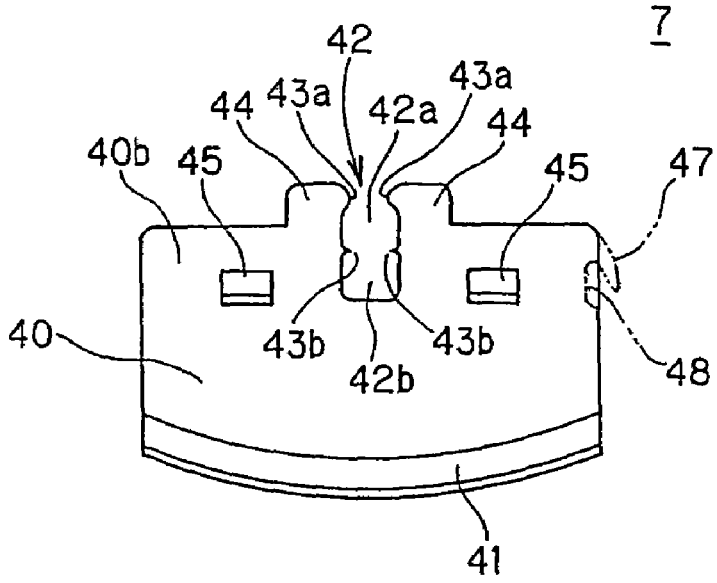
FIG. 14 is a plan view of a lock.
Figure 15A:
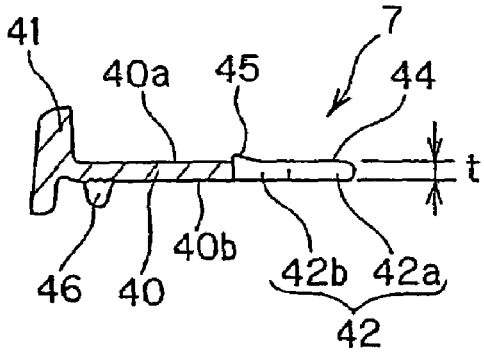
FIG. 15A is a sectional view of the lock in a front to back direction.

In contrast, as shown in FIGS. 14 and 15A, the lock 7 includes a plate-shaped main body 40 and a finger-placing portion 41 disposed at the front end of the main body 40. The thickness t of the main body 40 is maximized in the range in which main body 40 can pass through the groove portion 37 of the push button 6. A groove portion 42 is disposed to the main body 40 at the center of the rear end thereof. The groove portion 42 opens in the direction where the lock 7 is inserted into the push button 6 (the direction of an arrow A of FIGS. 10 and 16) so as to receive the shaft portion 35 of the push button 6. Pairs of right and left pawl portions 43*a* and 43*b* are formed at the inlet portion and the intermediate portion of the groove portion 42, respectively so that the width of the groove portion 42 is reduced thereby. The inside of the groove portion 42 is separated into a first holding portion 42*a* and a second holding portion 42*b* by these pawl portions 43*a* and 43*b*.

Figure 15B:
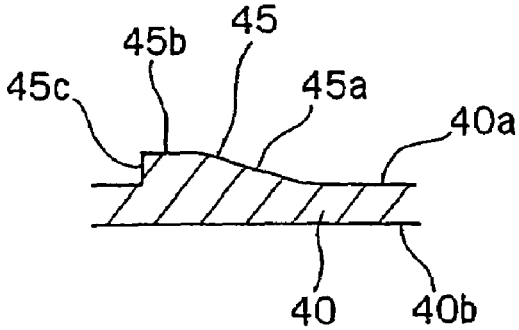
FIG. 15B is a partly enlarged view of the sectional view of FIG. 15A.

Lock portions 44 are formed on both the sides of the inlet of the groove portion 42. Further, a pair of stoppers 45 are formed on the upper surface 40*a* of the main body 40, and a pair of leg portions 46 are formed on the lower surface 40*b* thereof. The amount of protrusion of the leg portions 46 from the lower surface 40*b* is approximately the same as the amount of protrusion of the finger-placing portion 41 from the lower surface 40*b*. As shown in FIG. 15B, each of the stoppers 45 has a wedge surface 45*a*, which extends while drawing a downward inclination toward the lock portions 44, an apex surface 45*b*, and a locking surface 45*c* that is approximately orthogonal to the apex surface 45*b*.

Figure 16:
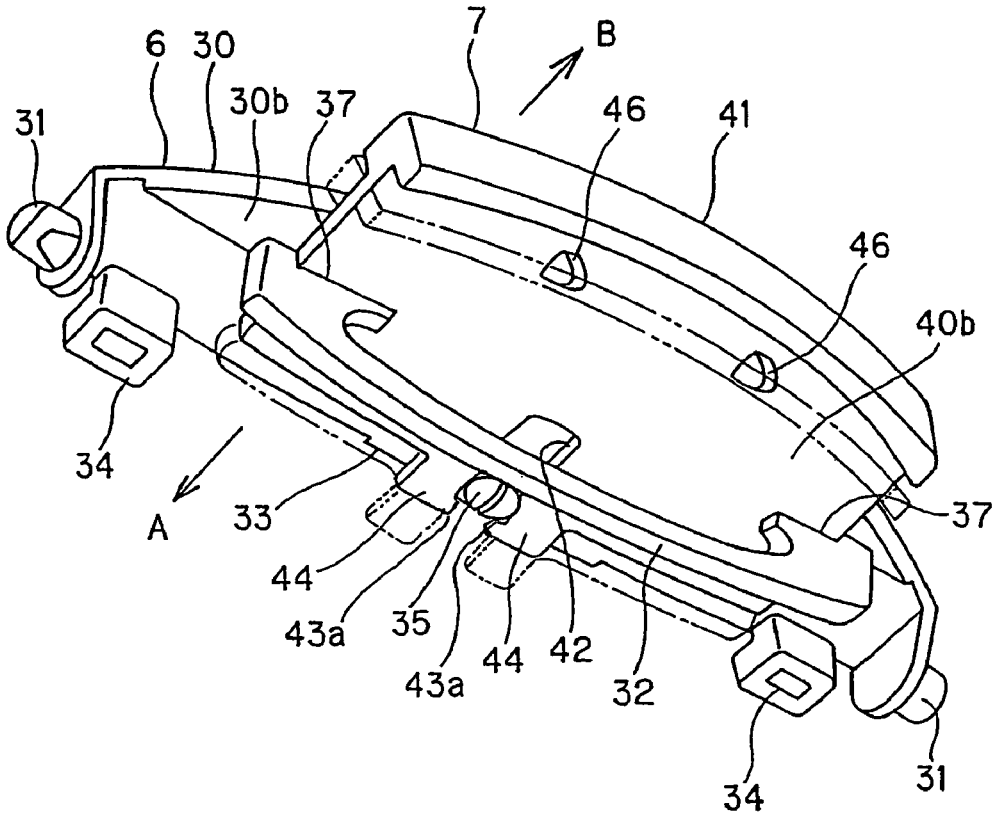
FIG. 16 is a perspective view of the state that the lock is attached to the push button when it is observed from an obliquely lower direction.

As shown in FIG. 16, the lock 7 is attached to the push button 6 in such a state that it comes into approximately intimate contact with the guide surface 30*b* of the push button 6 by depressing the main body 40 of the lock 7 into the groove portion 37 of the push button 6 from the lock portions 44 side as well as inserting the shaft portion 35 of the push button 6 into the groove portion 42 of the lock 7. When the lock 7 is attached to the push button 6, the shaft portion 35 of the push button 6 gets over the pawl portions 43*a* formed on the groove portion 42 of the lock 7 and engaged with the first holding portion 42*a*. When the stoppers 45 passe through the groove portion 37, the groove portion 37 is gradually enlarged along the wedge surfaces 45*a*, and when the stoppers 45 get over the stepped portion 38, the groove portion 37 returns to its original width. With the above operation, the lock 7 is prevented from being extracted from the push button 6.

When the lock 7 is further depressed in the inserting direction in the state that the shaft portion 35 is engaged with the first holding portion 42*a*, the shaft portion 35 gets over the pawl portions 43*b* of the lock 7 and is engaged with the second holding portion 42*b*. As described above, the lock 7 can slide along the guide surface 30*b* of the push button 6 between a release position (position shown by a solid line in FIG. 16), at which the first holding portion 42*a* is engaged with the shaft portion 35, and a locking position (position shown by a solid line in FIG. 10), at which the second holding portion 42*b* is engaged with the shaft portion 35.

Although the push button 6 and the lock 7 can be composed of the resin molded products as described above, a luminous material may be mixed with the material of any one of them so that the location of the container 1 can be found in a dark place. When the push button 6 and lock 7 emit light, the operating portion of the container 1 can be easily discriminated even in the dark place. Since the size and the volume of the push button 6 and the lock 7 are smaller than those of the container main body 2 and the upper lid 4, the amount of the luminous material to be mixed is small, by which an increase in cost resulting from mixing of the luminous material can be minimized.

The push button 6 and the lock 7 arranged as described above are attached to the container main body 2 in the state that they can be turned about the support shafts 31 by, first, attaching the lock 7 to the push button 6 and then engaging the support shafts 31 of the push button 6 with non-illustrated bearing portions opened to a button attachment groove 25 of the container main body 2 (refer to FIGS. 1B and 10).

Next, the operations of the push button 6 and the lock 7 will be explained. As apparent from FIG. 10, in the state that the push button 6 is attached to the button attachment groove 25, the spring portion 32 comes into contact with the bottom surface 25*a* of the button attachment groove 25, and the push button 6 is turned and urged clockwise in FIG. 10 about the support shafts 31 by the repulsive force (restoring force to elastic deformation) of the spring portion 32. Accordingly, when the upper lid 4 is closed, it is kept in a closed state by that the pawl portion 33 of the push button 6 is meshed with the pawl portion 4*h* of the upper lid 4 by the force of the spring portion 32 of the push button 6. The position of the push button 6 at the time corresponds to a close position.

When the lock 7 is depressed to the locking position in the state that the upper lid 4 is closed, the leg portions 46 of the lock 7 are abutted against the locking surface 25*b* of the button attachment groove 25 (FIG. 10). Accordingly, since it becomes impossible to depress the operation surface 30*a* of the pushbutton 6, the pawl portion 33 meshed with the pawl portion 4*h* cannot be released therefrom. Moreover, at the locking position, the lock portions 44 of the lock 7 protrude from the push button 6 and are engaged with the lock hole 4*j* of the upper lid 4. Since the lock portions 44 are engaged with the lock hole 4*j* in a sufficiently large amount of depth in comparison with the amount of mesh of the pawl portion 33 with the pawl portion 4*h*, even if the push button 6 or the upper lid 4 is elastically deformed in such a degree as to release the pawl portion 33 from the pawl portion 4*h*, the upper lid 4 can be securely restrained at the close position by the lock 7.

In contrast, when the lock 7 is drawn out from the push button 6 in an extracting direction (the direction of an arrow B of FIGS. 10 and 16) and moved to the release position, the lock portions 44 are extracted from the lock hole 4*j* as well as the leg portions 46 are away from the locking surface 25*b*. With the above operation, the upper lid 4 can be opened by releasing the pawl portion 33 and the pawl portion 4*h* from each other by depressing the operation surface 30*a* of the push button 6 (this state corresponds to the open position of the push button 6). Since the push-up portions 34 of the push button 6 are fitted with the cutouts 4*k* of the upper lid 4, and when the operation surface 30*a* of the push button 6 is depressed, the push-up portions 34 lift the upper lid 4. Therefore, even if a relatively large resistance acts when the upper lid 4 is opened because a wet tissue 102 is caught between the close rib 4*f* of the upper lid 4 and the side wall 22*b* of the second concave portion 22, the upper lid 4 can be securely opened.

Note that, as shown by an imaginary line in FIG. 10, when the lock 7 is drawn out from the push button 6, the locking surfaces 45*c* of the stoppers 45 come into contact with the stepped portion 38 of the guide surface 30*b* of the push button 6, thereby the lock 7 is prevented from being extracted. As shown by an imaginary line in FIG. 14, to more securely prevent the extraction of the lock 7, a pawl portion 47, which obliquely protrudes in the drawing-out direction of the lock 7, and a concave portion 48 for receiving the pawl portion 47 may be formed to at least one of the side edges of the main body 40 of the lock 7 so that the pawl portion 47 is elastically deformed in the concave portion 48 when the lock 7 is inserted into the groove portion 37 and the pawl portion 47 is opened by the restoring force thereof after the lock 7 has passed through the groove portion 37.

Since the finger-placing portion 41 of the lock 7 protrudes from the operation surface 30*a*, the finger-placing portion 41 can be operated with a finger put thereon not only when the lock 7 is slid between the locking position and the release position but also when the upper lid 4 is opened by depressing the push button 6. When the upper lid 4 is opened, the lock 7 is drawn out to the release position and the distance from the support shafts 31 to the finger-placing portion 41 is increased, thereby an operation force for opening the upper lid 4 is reduced by the action of a lever.

The lock 7 is restrained (supported) by the push button 6 as to the depressing direction of the push button 6 by the main body 40 of the lock 7 that is inserted into the groove portion 37 of the push button 6. Thus, even if only the finger-placing portion 41 is depressed, the lock 7 and the push button 6 are turned together about the support shafts 31 without being away from each other, thereby the upper lid 4 can be securely opened.

In the container 1 with the lid described above, as shown in FIGS. 4 and 10, the upper end of the finger-placing portion 41 protrudes from the outside surface (top surface 2*a*) of the container main body 2. When the container 1 is shipped as a product with the package 100 accommodated in the container main body 2, a shrink film may be wrapped around the constricted central portion of the container 1. The shrink film is wrapped around the outside surface of the container 1 relatively tightly making use of thermal shrinkage. Thus, if the lock 7 is omitted and a part of the push button 6 is caused to protrude from the outside surface of the container main body 2, the protruding portion of the push button 6 is depressed by the shrink film, and the push button 6 is restrained in the state that the spring portion 32 is somewhat bent. When this state is continued for a long time, the spring performance of the spring portion 32 is deteriorated, so that the push button 6 may be moved even by a minute shock after the shrink film is removed, thereby the upper lid 4 may be unintentionally opened. According to the container 1 of the embodiment, since the lock 7 is depressed to the locking position and the push button 6 is kept at the close position at which the pawl portion 33 is meshed with the pawl portion 4*h*, the push button 6 is not pushed even if the shrink film is wrapped. Accordingly, there is not a possibility that the spring performance of the spring portion 32 is deteriorated.

Further, since the container main body 2 and the bottom lid 3 are formed in the constricted shape, if the width of the shrink film is so large that the shrink film reaches the swelled portion of the container main body 2, the film may be risen from the container main body 2 on the front and rear side surfaces 2*b* and 2*c* of the container main body 2, and the push button 6 and the lock 7 may be away from the inside of the shrink film. In this case, the push button 6 and the lock 7 are prevented from being damaged by being rubbed against the shrink film at the portion thereof in contact with the film.

The constricted shape of the container main body 2 and the ring portion 14 disclosed in the embodiment described above can be also applied to a container with a lid in which the lock 7 is omitted. The push-up portions 34 may be disposed to the lock 7 in place of the operation member. The shape of the spring portion 32 is not limited to the bow shape and may be formed in a cantilever state. The shapes of the push button 6 and the lock 7 may be appropriately modified according to the shape of the container main body 2 and the like. The push button 6 and the lock 7 may be disposed so as to be back away into the button attachment groove 25 in their entireties beyond the outside surface (top surface 2*a* and side surface 2*b*) of the container main body 2.

In the above embodiment, the terms of the top surface, the bottom surface, the side surfaces, and the upper lid only specifies the positions of the respective portions relatively on the basis that the container is disposed with the take-out port facing upward, and when the container is actually used, the positions of the respective portions are not limited by these terms. For example, the container with the lid of the present invention may be used in the state that the take-out port faces laterally.

The present invention is by no means limited to the above embodiment and may be embodied in various modes. For example, the content is not limited to the wet tissues. The container with the lid of the present invention is not limited to the arrangement that the content is loaded and unloaded by detaching the bottom lid, and the content may be loaded, unloaded, and replaced by any appropriate mode.

As described above, according to the present invention, moving the locking member to the locking position makes it impossible to operate the operation member to the open position, and furthermore the locking member is meshed with the lid at the locking position, thereby the lid can be securely prevented from being unintentionally opened by a misoperation and the like. Since the locking member is attached to the operation member, the operation member can be assembled to the locking member before they are attached to the container main body, which reduces a trouble when they are attached to the container main body. Thus, the operation member and the locking member can be easily attached to the container main body.

Further, when container main body is formed in the shape constricted at the central portion thereof when it is viewed from the take-out port side, the container can be easily gripped. In addition to the above, when the film is wrapped around the outside periphery of the container, the container can be prevented from being damaged by being rubbed with the film by raising the film from the operation member and the like at the constricted portion. Further, when the strap attachment portion is provided, the container with the lid can be kept by being hung down.

The invention claimed is:

1. A container with an auto-opening lid comprising a container main body having a take-out port for a content, a lid attached to the container main body so as to open and close the take-out port, a lid urging device interposed between the container main body and the lid for urging the lid in an opening direction, and an operation member attached to the container main body in the state that the operation member can be operated between a close position at which it is meshed with the lid and keeps the lid in a closed state against the lid urging device and an open position at which the operation member is released from the lid meshed therewith, wherein:

a locking member is attached to the operation member, the locking member being movable between a locking position and a release position, when the locking member is at the locking position, the locking member is meshed with a lid that is in the closed state and the locking member is abutted against a locking surface of the container main body, thereby to make it impossible for the operation member to be operated from the close position to the open position, and when the locking member is at the release position, the locking member is separated from the lid that is in the closed state and from the locking surface of the container main body and permits the operation member to be operated from the close position to the open position, and wherein an operation surface, which is exposed to an outside surface side of the container main body, is formed to the operation member, and the locking member is disposed so as to be movable between the locking position and the release position on a back surface side of the operation surface, wherein the operation member is disposed so as to move from the close position to the open position by depressing the operation surface, and the locking member is disposed so as to move between the locking position and the release position in the state that it is supported by the operation member as to the direction in which the operation surface is depressed, and further wherein a guide surface, which is in contact with the locking member, is formed on the back surface side of the operation member as well as a spring portion, which protrudes from the guide surface and urges the operation member to the close position, is disposed to the back surface side thereof, and the locking member is supported so as to be slidable between the locking position and the release position while being in contact with the guide surface by being inserted into a first groove portion formed in the spring portion.

2. A container with an auto-opening lid according to claim 1, comprising an extraction prevention device for preventing the locking member from being extracted from the first groove portion of the operation member.

3. A container with an auto-opening lid according to claim 2, wherein a shaft portion, which is divided by a slit, is disposed on the back surface side of the operation member, a second groove portion, which is engaged with the shaft portion, is formed to the locking member so as to open in the direction in which the locking member is inserted into the second groove portion of the operation member, and a pawl portion as the extraction prevention device, which reduces the width of the groove, is disposed in the groove.

4. A container with an auto-opening lid according to claim 3, wherein the second groove portion of the locking member is partitioned by the pawl portion to a first holding portion, to which the shaft portion is fitted when the locking member is located at the release position, and a second holding portion to which the shaft portion is fitted when the locking member is located at the locking position.

5. A container with an auto-opening lid according to claim 2, wherein a stepped portion is disposed on the back surface side of the operation member, and a protruding stopper as the extraction prevention device is disposed on the surface of the locking member confronting the operation member, the stopper being capable of being engaged with the stepped portion as to the direction in which the locking member is extracted from the first groove portion of the operation member as well as extending in a wedge state as to the direction in which the locking member is inserted into a second groove portion of the operation member.

6. A container with an auto-opening lid according to claim 2, wherein a pawl portion is disposed on the locking member.

* * * * *